US006731895B2

(12) United States Patent
Hamada et al.

(10) Patent No.: US 6,731,895 B2
(45) Date of Patent: May 4, 2004

(54) IMAGE FORMING APPARATUS WITH SIMPLE TRANSFER BELT TENSION MECHANISM

(75) Inventors: Futoshi Hamada, Toyokawa (JP); Eiji Nakane, Okazaki (JP)

(73) Assignee: Minolta Co., Ltd., Osaka (JP)

( * ) Notice: Subject to any disclaimer, the term of this patent is extended or adjusted under 35 U.S.C. 154(b) by 18 days.

(21) Appl. No.: 10/102,879

(22) Filed: Mar. 22, 2002

(65) Prior Publication Data

US 2002/0136566 A1 Sep. 26, 2002

(30) Foreign Application Priority Data

Mar. 23, 2001 (JP) ..... 2001-084900

(51) Int. Cl.[7] ..... G03G 15/00; G03G 15/01; G03G 15/08

(52) U.S. Cl. ..... 399/121; 399/165; 399/302; 399/303

(58) Field of Search ..... 399/121, 162, 399/165, 164, 302, 303

(56) References Cited

U.S. PATENT DOCUMENTS 4,178,094 A * 12/1979 Silverberg ..... 399/165
4,563,077 A * 1/1986 Komada ..... 399/165
4,626,095 A * 12/1986 Berger ..... 399/165
5,019,864 A * 5/1991 Blanding ..... 399/165
5,612,771 A * 3/1997 Yamamoto et al. ..... 399/121 X
5,701,568 A * 12/1997 Hiroshima et al. ..... 399/302
5,802,422 A 9/1998 Hokari ..... 399/36
5,897,241 A * 4/1999 Takano et al. ..... 399/162
5,978,615 A 11/1999 Tanaka et al. ..... 399/49
6,029,033 A 2/2000 Kawasaki ..... 399/149
6,061,542 A 5/2000 Minami et al. ..... 399/299
6,108,510 A 8/2000 Nakane ..... 399/303
6,125,994 A * 10/2000 Todome ..... 399/303 X
6,249,662 B1 * 6/2001 Lee ..... 399/165

FOREIGN PATENT DOCUMENTS

JP 7-28294 1/1995

* cited by examiner

*Primary Examiner*—Fred L. Braun
(74) *Attorney, Agent, or Firm*—Morrison & Foerster LLP

(57) ABSTRACT

An image forming apparatus includes a transfer belt unit having a driving roller, a follower roller whose outer peripheral portion is formed of an elastic material and a transfer belt which is made of a resin and stretched between the driving roller and the follower roller. The elastic modulus of the outer peripheral portion of the follower roller is lower than that of the driving roller. The transfer belt unit is configured to be bent in the middle, or to change its direction in the longitudinal direction thereof.

20 Claims, 5 Drawing Sheets

IMAGE FORMING APPARATUS WITH SIMPLE TRANSFER BELT TENSION MECHANISM

RELATED APPLICATION

This application is based on Japanese Patent Application No. 2001-84900, the content of which is incorporated herein by reference.

BACKGROUND OF THE INVENTION

The present invention relates to an image forming apparatus provided with a transfer belt, which receives an image directly transferred on its surface or a recording medium on the surface of which an image is to be transferred.

Conventionally, in an image forming apparatus of an electrophotographic system, it has become a mainstream to employ a resin hard belt of excellent electrical and mechanical characteristics as a transfer belt. Such a transfer belt is normally rotatively driven while being stretched between a driving roller and a follower roller. It is often the case where a special tension roller, to which a spring load is applied to give tension to the transfer belt, is employed in addition to the driving roller and the follower roller.

On the other hand, as another method of giving tension to the transfer belt without employing any special tension roller, there are the method of giving tension to the belt by imposing a spring load on a movably supported follower roller, the method of providing the transfer belt constructed of a rubber belt and giving tension to the belt by the flexibility of the belt itself.

However, the resin hard belt is appropriate for the transfer belt, and if proper tension can be given to the belt providing neither a special tension roller nor a spring load operation mechanism even when this resin hard belt is employed, then it is preferable in simplifying the mechanism and reducing the cost thereof.

SUMMARY OF THE INVENTION

Accordingly, the image forming apparatus of the present invention comprises:

a driving roller;

a follower roller whose outer peripheral portion is formed of an elastic material; and a transfer belt, which is made of a resin and stretched between the driving roller and the follower roller.

According to this construction, tension is given to the transfer belt by the elasticity of the elastic material itself of the follower roller. Accordingly, there can be provided an image forming apparatus, which needs no special tension roller and has a small-sized inexpensive transfer belt unit. Furthermore, because the elasticity is possessed not by the driving roller but by the follower roller, the transfer belt can be rotatively driven at a stabilized velocity by the driving roller having no elasticity, and a satisfactory image, which has neither color drift nor magnification shift, can be formed.

It is acceptable that the image forming apparatus of the present invention comprises a transfer belt unit constructed of the driving roller, the follower roller, the transfer belt and a frame for supporting the driving roller and the follower roller, the transfer belt unit is provided while being able to be mounted on and demounted from the image forming apparatus, and the frame is provided while being able to bend in the middle.

According to this construction, the distance between the driving roller and the follower roller can be expanded and contracted by the bend in the middle of the frame, and the mounting and demounting of the transfer belt on and from the rollers can easily be performed.

Moreover, it is acceptable that an image forming apparatus of the present invention comprises a transfer belt unit constructed of the driving roller, the follower roller, the transfer belt and a frame for supporting the driving roller and the follower roller, the transfer belt unit is provided while being able to be mounted on and demounted from the image forming apparatus, and the frame is provided while being able to expand and contract.

According to this construction, the distance between the driving roller and the follower roller can be expanded and contracted by the expansion and contraction of the frame, and the transfer belt can easily be mounted on and demounted from the rollers.

Moreover, it is preferable that the elastic material of the follower roller has an Asker-C hardness of not greater than 35 degrees.

According to this construction, optimum tension can be given to the transfer belt.

Moreover, it is acceptable that the follower roller has varied outside diameters in the center portion and the end portions thereof.

According to this construction, the transfer belt can be prevented from meandering.

Moreover, it is acceptable that the transfer belt is an intermediate transfer belt, and a transfer member for transferring an image carried on the intermediate transfer belt onto a recording medium is arranged on the driving roller side.

According to this construction, by providing the transfer member not on the follower roller side that the elastic deformation is caused by the tension of the transfer belt but on the driving roller side that such a deformation does not occur, stabilized image transfer can be performed.

Moreover, the image forming apparatus of the present invention is permitted to be provided with a driving roller, a follower roller whose outer peripheral portion is formed of an elastic material and a transfer belt that is made of a resin and stretched between the driving roller and the follower roller and given tension only by the elasticity of the follower roller. In this case, the transfer belt may be supported only by the two rollers of the driving roller and the follower roller.

Also, with this construction, tension is given to the transfer belt by the elasticity of the elastic material of the follower roller, and therefore, no special tension roller is required to be provided, allowing an image forming apparatus having a small-sized inexpensive transfer belt unit to be provided. Furthermore, because the elasticity is possessed not by the driving roller but by the follower roller, the transfer belt can be rotatively driven at a stabilized velocity by the driving roller having no elasticity, and a satisfactory image, which has neither color drift nor magnification shift, can be formed.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

Figure 1:
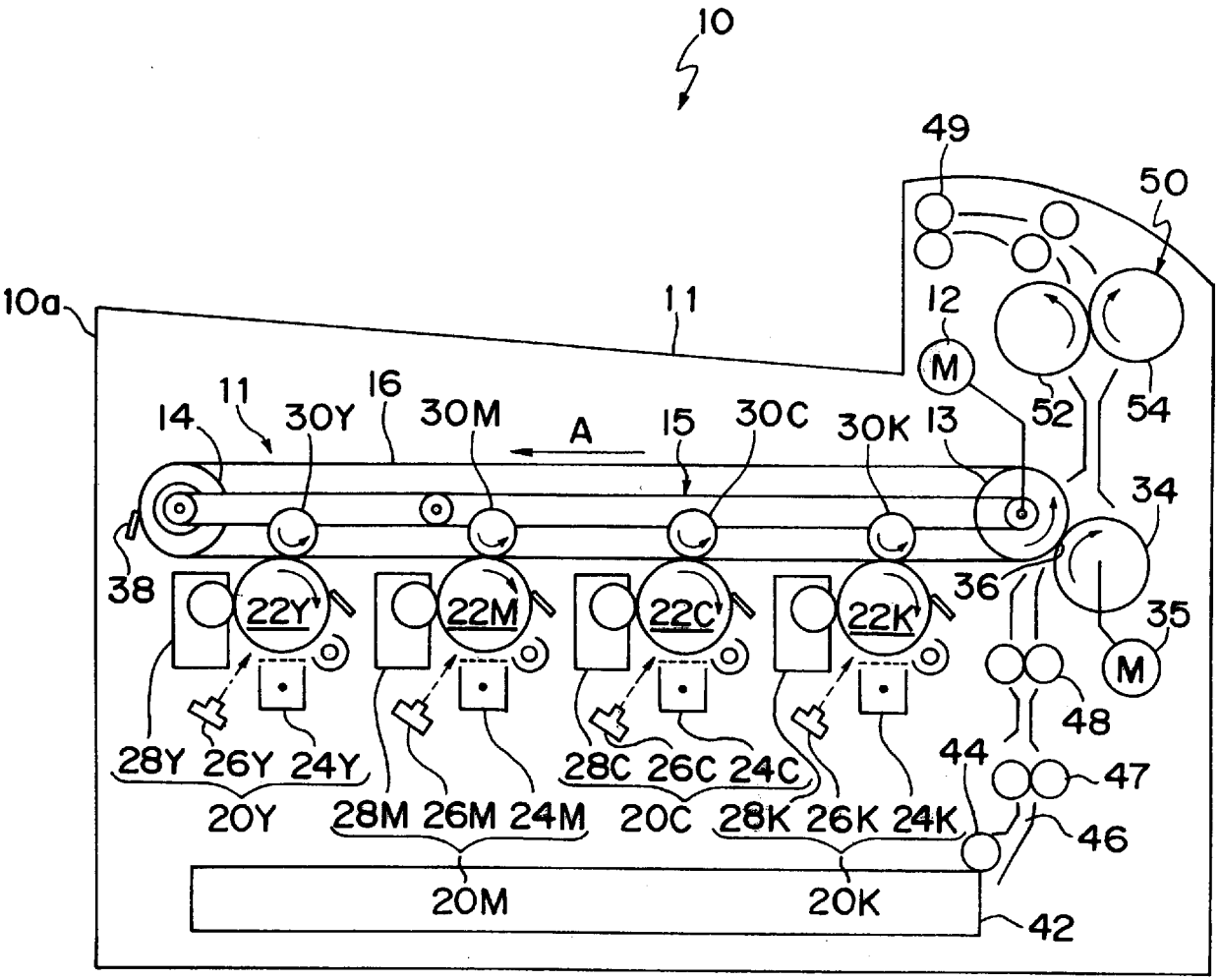
FIG. 1 is an overall schematic structural view of a printer.

FIG. 1 is an overall structural view of a tandem type digital color printer (referred to simply as a "printer" hereinafter) 10 according to one embodiment of the present invention.

Figure 2:
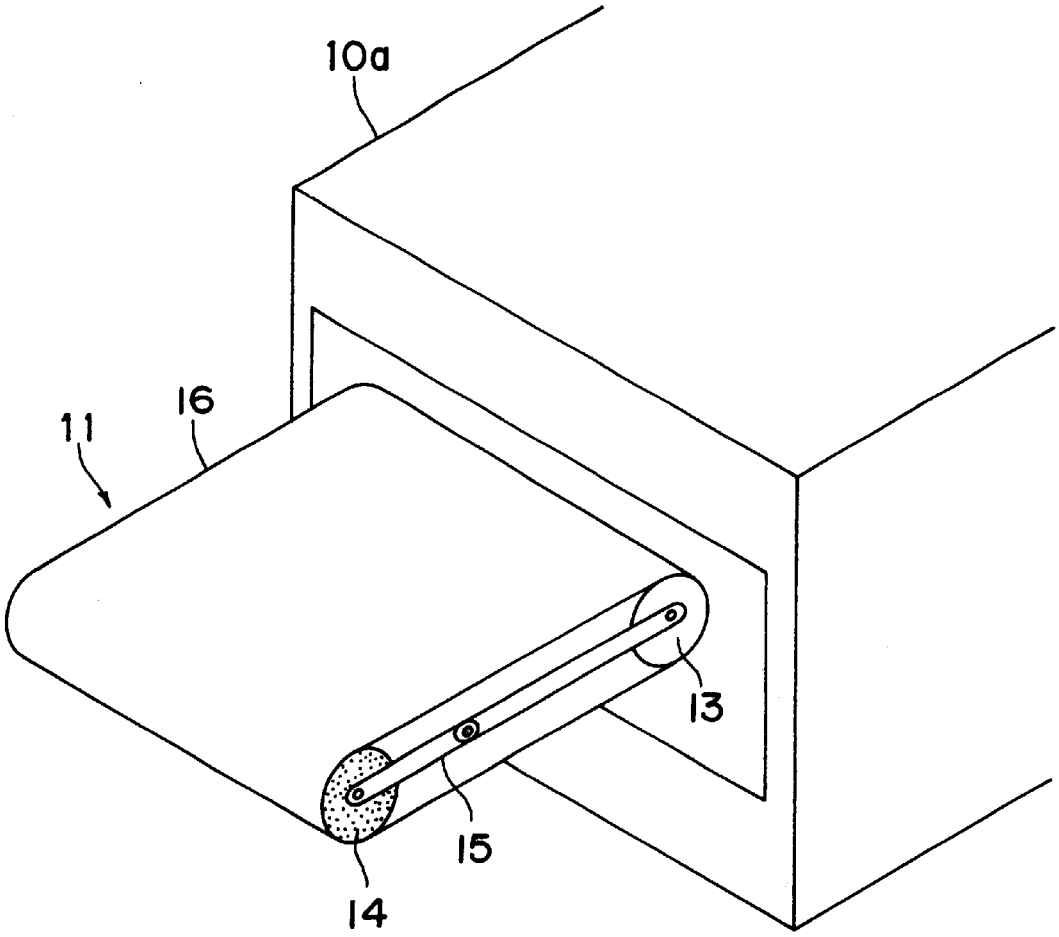
FIG. 2 is a view showing a transfer belt unit that can be mounted on and demounted from the main body.

The printer 10 is provided with a transfer belt unit 11 located roughly at the center of the inside thereof. The transfer belt unit 11 is constructed of a driving roller 13 that is operably connected to a motor 12, a follower roller 14 arranged apart from the driving roller 13 and an intermediate transfer belt (transfer belt) 16 stretched between the driving roller 13 and the follower roller 14. The driving roller 13 and the follower roller 14 are rotatably supported by a frame 15. The intermediate transfer belt 16 is to be rotated in the direction of arrow A by the driving roller 13 driven by the motor 12. As shown in FIG. 2, the transfer belt unit 11 can be integrally mounted on and demounted from a printer main body 10*a* through a side portion of the body.

It is to be noted that one or both of the driving roller 13 and the follower roller 14 may have varied outside diameters in the center portion and the end portions thereof. With this arrangement, the intermediate transfer belt 16 can be prevented from meandering when rotatively driven.

Figure 3A:
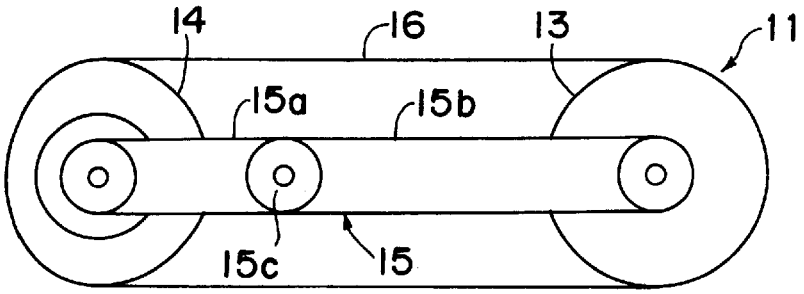
FIG. 3A is a view showing a state in which an intermediate transfer belt is stretched tight in the transfer belt unit.
Figure 3B:
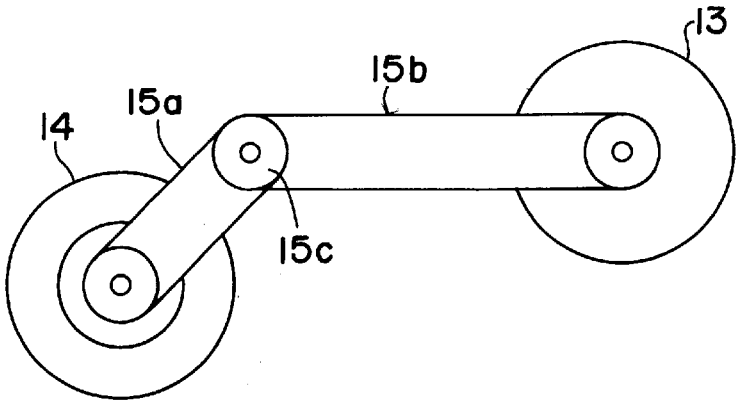
FIG. 3B is a view showing a state in which the intermediate transfer belt is demounted by contracting a frame in the transfer belt unit.

As shown in FIGS. 3A and 3B, the frame 15, which supports the driving roller 13 and the follower roller 14, is constructed of a plurality of (two in the present embodiment) members 15*a* and 15*b* joined via a shaft 15*c*. The members 15*a* and 15*b* can pivot around the shaft 15*c* that serves as a fulcrum, by which the frame 15 can bend in the middle in the position of the shaft 15*c*. By extending straight and bending the frame 15 in the middle, a distance between the driving roller 13 and the follower roller 14 is to expand and contract. Therefore, the intermediate transfer belt 16 can easily be mounted on and demounted from the rollers 13 and 14 by bending the frame 15 in the middle as shown in FIG. 3B.

Figure 4:
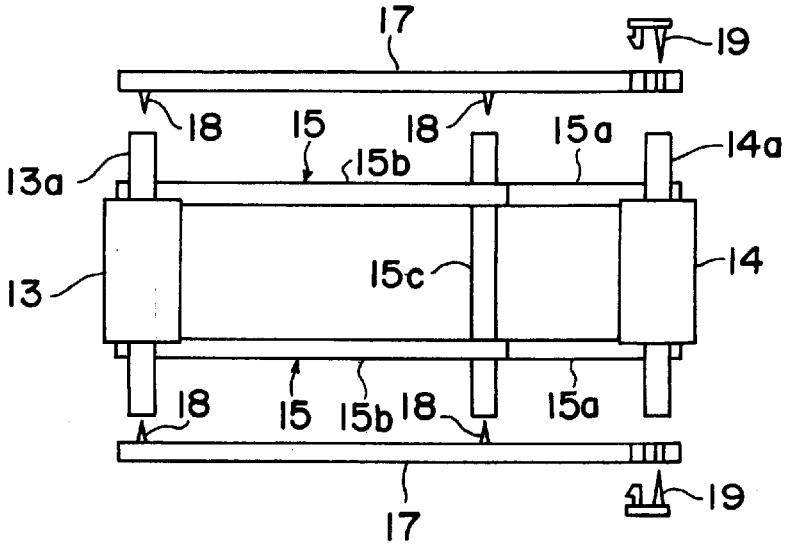
FIG. 4 shows a state in which the frame of the transfer belt unit is retained while being stretched by a retention member.

Moreover, as shown in FIG. 3A, if the frame 15 is extended straight in a state in which the intermediate transfer belt 16 is mounted, then the intermediate transfer belt 16 is to be stretched tight between the rollers 13 and 14. At this time, as shown in FIG. 4, by inserting the pins 18 of retention members 17 into holes located at both ends of the shaft 13*a* of the driving roller 13 and the shaft 15*c* of the frame 15, respectively, and inserting retention pins 19 into holes located at both ends of the shaft 14*a* of the follower roller 14 via the through holes of the retention members 17, the frame 15 is retained in a straightly extended state.

Figure 5A:
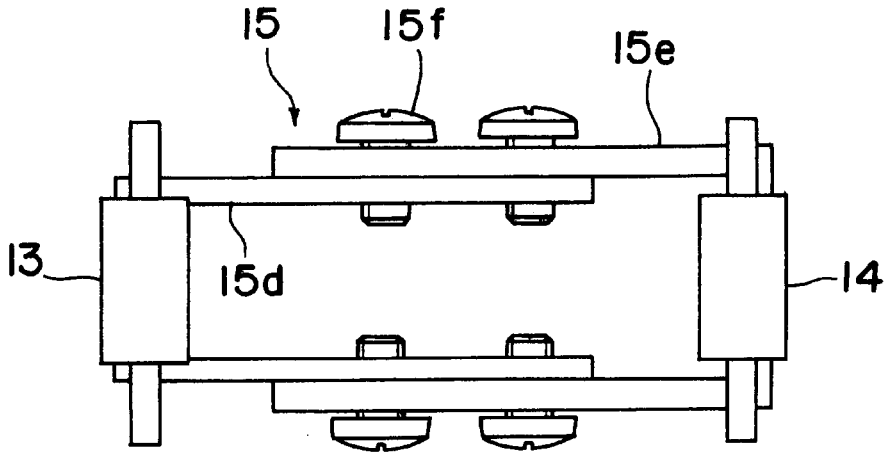
FIGS. 5A and 5B are views showing another example of the frame of the transfer belt unit.
Figure 5B:
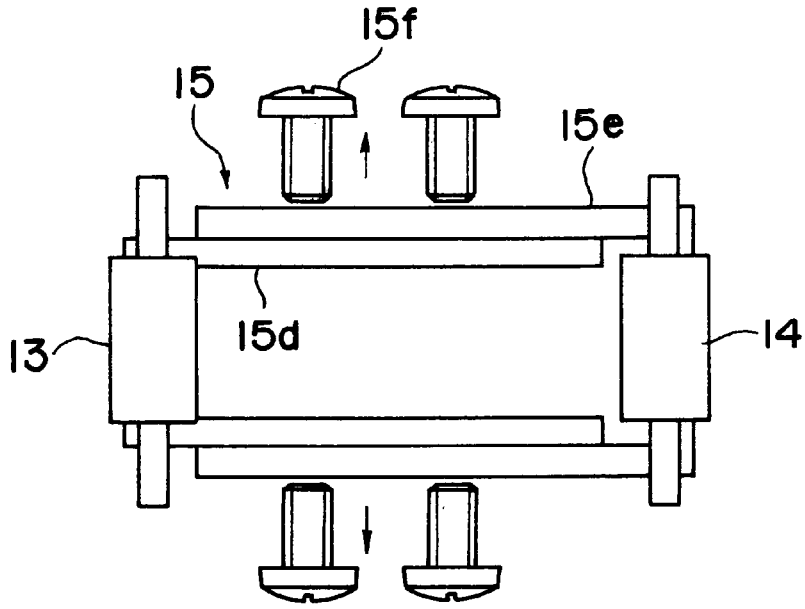

It is to be noted that the construction of the frame 15 is not limited to the construction capable of bending in the middle as described above and only required to be a construction such that the distance between the driving roller 13 and the follower roller 14 can expand and contract. For example, as shown in FIGS. 5A and 5B, it is acceptable to construct the frame 15 by combining a plurality of (two in this case) members 15*d* and 15*e* that have a bracket-like upper surface shape so that the members can slide relative to each other for the expansion and contraction, retain the frame 15 in the extended state by screws 15*f* as shown in FIG. 5A when the belt is mounted and contract the frame 15 by removing the screws 15*f* as shown in FIG. 5B when the belt is demounted.

The intermediate transfer belt 16 is a belt, which is made of a resin of a small expandability, such as polycarbonate, polyimide, fluorine-based resin or nylon and distinguished from a belt made of a rubber of a large expandability.

The driving roller 13 is constructed of, for example, a metal pipe or a solid resin roller and has high rigidity. In contrast to this, the follower roller 14 has its outer peripheral portion made of a thick elastic material. With this arrangement, as shown in FIG. 3A, when the frame 15 is expanded to stretch the intermediate transfer belt 16 tight, a portion that belongs to the follower roller 14 and is brought in contact with the belt is deformed in a compressed manner. By the elasticity of this deformed portion, a proper tension is given to the intermediate transfer belt 16. Accordingly, there is no need for providing a special tension roller for giving tension to the intermediate transfer belt 16, and as a result, the transfer belt unit 11 can be made compact and inexpensive. Moreover, the intermediate transfer belt 16 is rotatively driven not by the follower roller 14 elastically deformed but by the driving roller 13 of high rigidity. Therefore, the intermediate transfer belt 16 can be rotated at a stabilized velocity, and a satisfactory image free from color drift and magnification shift can be formed in an image forming operation described later.

As an elastic material that constitutes at least the outer peripheral portion of the follower roller 14, there can be enumerated rubber materials of a styrene-butadiene type, a polyurethane type, a diene type, a silicon-containing polymer type, a polyolefin type and the like. Moreover, in the case of a foam type rubber material, it is easy to obtain the desired elasticity by density control.

The aforementioned elastic material should preferably have a rubber hardness of not greater than 35 degrees by Asker-C hardness. By setting the rubber hardness as described above, an optimum tension can be given to the intermediate transfer belt 16 stretched tight between the rollers 13 and 14.

Referring again to FIG. 1, four image forming units 20Y, 20M, 20C and 20K corresponding to the toners of the colors of yellow (Y), magenta (M), cyan (C) and black (K), respectively, are arranged along the intermediate transfer belt 16 under the lower horizontal portion of the intermediate transfer belt 16.

The image forming units 20Y, 20M, 20C and 20K have photoreceptor drums 22Y, 22M, 22C and 22K, respectively. Around the photoreceptor drums 22Y, 22M, 22C and 22K are provided electric chargers 24Y, 24M, 24C and 24K for uniformly electrically charging the surfaces of the photoreceptor drums 22Y, 22M, 22C and 22K, printing head sections 26Y, 26M, 26C and 26K for forming electrostatic latent images by exposing the uniformly charged surfaces of the photoreceptor drums to light according to the image data of the respective colors, developers 28Y, 28M, 28C and 28K for forming toner images by developing the electrostatic latent images formed on the surfaces of the photoreceptor drums with the toners of respective colors, primary transfer rollers 30Y, 30M, 30C and 30K, which face the photoreceptor drums 22Y, 22M, 22C and 22K with interposition of the intermediate transfer belt 16 and primarily transfer the toner images formed on the photoreceptor drum surfaces onto the intermediate transfer belt 16 by electrostatically attracting the toner images, and so on, arranged in this order in the direction of rotation of the drums. The printing head sections 26Y, 26M, 26C and 26K are constructed of numbers of LEDs arranged in a main scanning direction parallel to the axial direction of the photoreceptor drums.

A secondary transfer roller (transfer member) 34, which is rotatively driven in the direction of arrow by a motor 35, is brought in pressure contact with the driving roller 13 via the intermediate transfer belt 16. A nip portion between the secondary transfer roller 34 and the intermediate transfer belt 16 serves as a transfer region 36. To the secondary transfer roller 34 is applied a high-voltage transfer voltage. A toner image formed on the intermediate transfer belt 16 by the transfer voltage is to be electrostatically attracted to a sheet conveyed to the transfer region 36 and subjected to secondary transfer, as described later. By virtue of the secondary transfer roller 34 provided not on the follower roller 14 side that the deformation occurs due to the stretching of the intermediate transfer belt 16 but on the driving roller 13 side that no such deformation occurs, the secondary transfer can stably be performed.

A cleaner (cleaning blade) 38 is brought in pressure contact with a portion that belongs to the intermediate transfer belt 16 and is supported by the follower roller 14. This cleaner 38 is of scraping off and collect the toner that stays on the intermediate transfer belt 16 after the secondary transfer.

A sheet feeding cassette 42 is detachably arranged under the image forming units 20Y, 20M, 20C and 20K in the lower portion of the printer 10. The sheets, which are the recording media loaded and stored in the sheet feeding cassette 42, are to be fed one by one successively from the uppermost one to a conveyance path 46 by the rotation of a sheet feeding roller 44.

The conveyance path 46 extends from the sheet feeding cassette 42 to a discharge roller pair 49 via a conveyance roller pair 47, the nip portion of a timing roller pair 48, the secondary transfer region 36 and the nip portion of a fixing roller pair 50. The timing roller pair 48 is of feeding the sheet sent from the sheet feeding cassette 42 to the transfer region 36 in synchronization with the image on the intermediate transfer belt 16.

The fixing roller pair 50 is constructed of a heating roller 52 provided with a built-in heater (not shown) and a pressurizing roller 54 brought in pressure contact with the heating roller 52, and is to be rotatively driven in the direction of arrow by a motor (not shown).

The operation of the printer 10 having the above construction will be described next.

When an image data is inputted from an external device (for example, a personal computer) to the image signal processing section (not shown) of the printer 10, the image signal processing section forms digital image signals obtained by the conversion of the image data into the signals of the colors of yellow, cyan, magenta and black, and the digital image signals are transmitted to an LED drive circuit for the print head. This drive circuit makes the printing head sections 26Y, 26M, 26C and 26K of the image forming units 20Y, 20M, 20C and 20K emit light for exposure on the basis of the inputted digital signal. This exposure is performed with a time delay in the order of the printing head sections 26Y, 26M, 26C and 26K. By this operation, electrostatic latent images of each color are formed on the surfaces of the photoreceptor drums 22Y, 22M, 22C and 22K, respectively.

The electrostatic latent images formed on the photoreceptor drums 22Y, 22M, 22C and 22K are developed by the developers 28Y, 28M, 28C and 28K so as to be formed into toner images of the respective colors. Then, the toner images of each color are subjected to the primary transfer by the operations of the primary transfer rollers 30Y, 30M, 30C and 30K to be successively superposed on one another on the intermediate transfer belt 16 that moves in the direction of arrow A.

The superposed toner images thus formed on the intermediate transfer belt 16 reaches the transfer region 36 in accordance with the movement of the intermediate transfer belt 16. In the transfer region 36, the toner images of each color superposed on one another are subjected to the secondary transfer by the operation of the secondary transfer roller 34 so as to be collectively transferred onto the sheet sent from the sheet feeding cassette 42 to the conveyance path 46 and fed by the timing roller pair 48. The toner staying on the intermediate transfer belt 16 after the secondary transfer is collected by the cleaner 38.

The sheet on which the toner images have been secondarily transferred is sent to the fixing roller pair 50 through the conveyance path 46, and the toner images are fixed on the sheet by heating while passing through the nip portion of the fixing roller pair 50. Then, the sheet is discharged through the discharge roller pair 49 onto a discharge sheet tray 11.

The color image forming operation is performed as described above. In the case of a monochrome image, only the image forming unit 20K operates on the basis of inputted monochrome image data, forming a black toner image on the intermediate transfer belt 16. Subsequently, in a similar manner, the black toner image is secondarily transferred onto a sheet in the transfer region 36, fixed on the sheet by heating by the fixing roller pair 50, and thereafter the sheet is discharged onto the discharge sheet tray 11.

Figure 6:
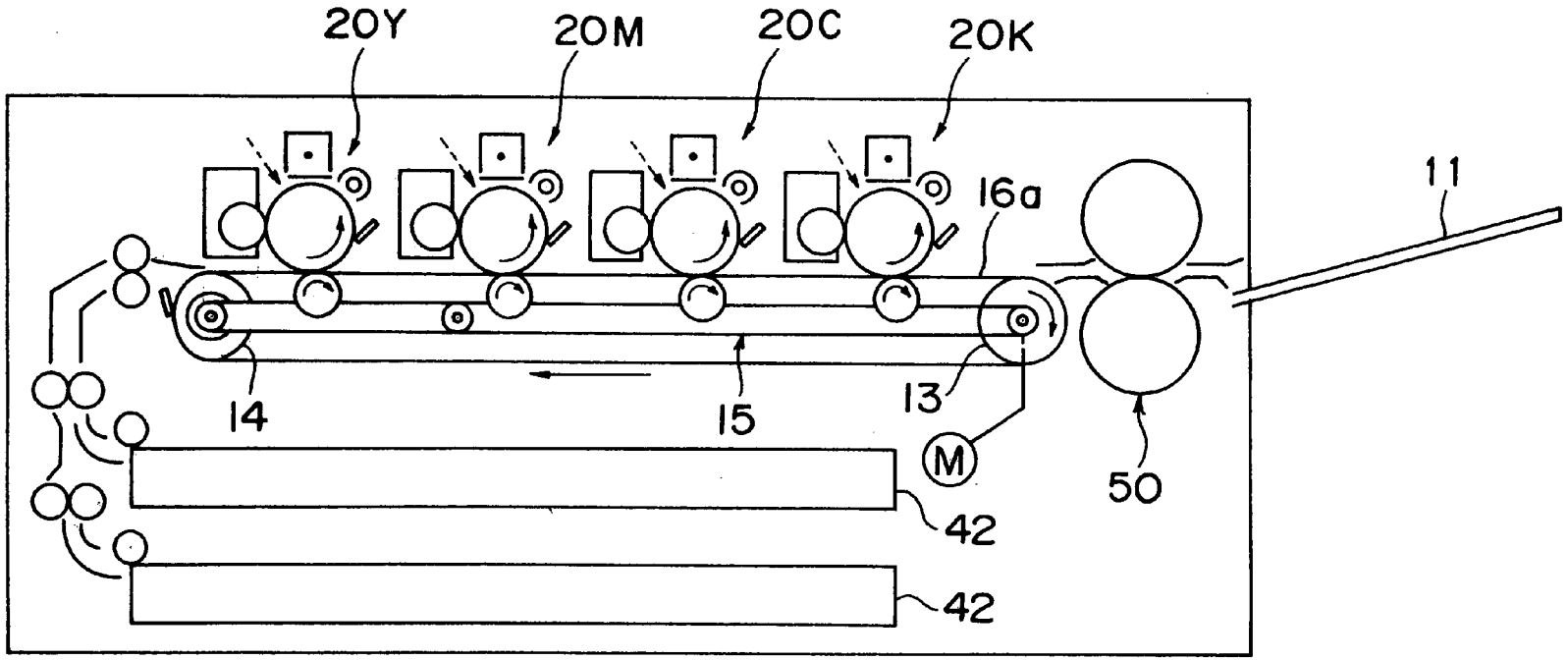
FIG. 6 is an overall schematic structural view of an image forming apparatus that has a conveyance transfer belt which conveys a recording medium.

In the present embodiment, there has been described the image forming apparatus 10 provided with the intermediate transfer belt 16 on the surface of which the toner images are directly transferred, taken as an example. However, as shown in FIG. 6, the present invention can also be applied to an image forming apparatus of a type such that a conveyance transfer belt (transfer belt) 16*a* conveys the sheet sent from the sheet feeding cassette 42 on its surface while retaining the sheet and toner images are directly formed on the sheet by the image forming units 20Y, 20M, 20C and 20K during the conveyance process.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included thereto.

What is claimed is:

1. An image forming apparatus comprising:

a driving roller;

a follower roller whose outer peripheral portion is formed of an elastic material; and a transfer belt, which is made of a resin and stretched between the driving roller and the follower roller, wherein the outer peripheral portion of the follower roller has an elastic modulus lower than an elastic modulus of the driving roller.

2. An image forming apparatus as claimed in claim 1, wherein the elastic material of the follower roller has an Asker-C hardness of not greater than 35 degrees.

3. An image forming apparatus as claimed in claim 1, wherein the follower roller has varied outside diameters in the center portion and the end portions thereof.

4. An image forming apparatus as claimed in claim 1, wherein the transfer belt is an intermediate transfer belt, and a transfer member for transferring an image carried on the intermediate transfer belt onto a recording medium is arranged on the driving roller side.

5. An image forming apparatus as claimed in claim 4, further comprising a transfer belt unit comprising the driving roller, the follower roller, the intermediate transfer belt and a frame for supporting the driving roller and the follower roller, and a plurality of image forming units for forming an image to be carried on the intermediate transfer belt.

6. An image forming apparatus as claimed in claim 5, wherein the plurality of image forming units are arranged below the transfer belt unit.

7. An image forming apparatus as claimed in claim 1, wherein the transfer belt is a conveyance transfer belt which conveys a recording medium, and the apparatus further comprises a transfer belt unit comprising the driving roller, the follower roller, the conveyance transfer belt and a frame for supporting the driving roller and the follower roller, and a plurality of image forming units for forming an image on the recording medium to be conveyed by the conveyance transfer belt.

8. An image forming apparatus comprising a driving roller;

a follower roller whose outer peripheral portion is formed of an elastic material;

a transfer belt, which is made of a resin and stretched between the driving roller and the follower roller; and a transfer belt unit comprising the driving roller, the follower roller, the transfer belt and a frame for supporting the driving roller and the follower roller, the transfer belt unit being configured to be mounted on and demounted from the image forming apparatus, and the frame being configured to bend within a plane perpendicular to the transfer belt.

9. An image forming apparatus comprising:

a driving roller;

a follower roller whose outer peripheral portion is formed of an elastic material;

a transfer belt, which is made of a resin and stretched between the driving roller and the follower roller; and a transfer belt unit comprising the driving roller, the follower roller, the transfer belt and a frame for supporting the driving roller and the follower roller, the transfer belt unit being configured to be mounted on and demounted from the image forming apparatus, and the frame being configured to change a distance between the driving roller and the follower roller.

10. An image forming apparatus comprising:

a driving roller;

a follower roller whose outer peripheral portion is formed of an elastic material; and a transfer belt, which is made of a resin and stretched between the driving roller and the follower roller, wherein the outer peripheral portion of the follower roller has an elastic modulus lower than an elastic modulus of the driving roller and is configured to be only source of generating a tension applied to the transfer belt.

11. An image forming apparatus as claimed in claim 10, wherein the transfer belt is supported by only the driving roller and the follower roller.

12. An image forming apparatus as claimed in claim 10, wherein the elastic material of the follower roller has an Asker-C hardness of not greater than 35 degrees.

13. An image forming apparatus as claimed in claim 10, wherein the follower roller has varied outside diameters in the center portion and the end portions thereof.

14. An image forming apparatus as claimed in claim 10, wherein the transfer belt is an intermediate transfer belt, and a transfer member for transferring an image carried on the intermediate transfer belt onto a recording medium is arranged on the driving roller side.

15. An image forming apparatus as claimed in claim 14, further comprising a transfer belt unit comprising the driving roller, the follower roller, the intermediate transfer belt and a frame for supporting the driving roller and the follower roller, and a plurality of image forming units for forming an image to be carried on the intermediate transfer belt.

16. An image forming apparatus as claimed in claim 15, wherein the plurality of image forming units are arranged below the transfer belt unit.

17. An image forming apparatus as claimed in claim 16, further comprising a recording medium supply unit for supplying the recording medium, the recording medium supply unit being arranged below the plurality of image forming units.

18. An image forming apparatus as claimed in claim 10, wherein the transfer belt is a conveyance transfer belt which conveys a recording medium, and the apparatus further comprises a transfer belt unit comprising the driving roller, the follower roller, the conveyance transfer belt and a frame for supporting the driving roller and the follower roller, and a plurality of image forming units for forming an image on the recording medium to be conveyed by the conveyance transfer belt.

19. An image forming apparatus comprising:

a driving roller;

a follower roller whose outer peripheral portion is formed of an elastic material;

a transfer belt, which is made of a resin and stretched between the driving roller and the follower roller, the outer peripheral portion of the follower roller being configured to be only source of generating a tension applied to the transfer belt; and a transfer belt unit comprising the driving roller, the follower roller, the transfer belt and a frame for supporting the driving roller and the follower roller, the transfer belt unit being configured to be mounted on and demounted from the image forming apparatus, and the frame being configured to bend within a plane perpendicular to the transfer belt.

20. An image forming apparatus comprising:

a driving roller;

a follower roller whose outer peripheral portion is formed of an elastic material;

a transfer belt, which is made of a resin and stretched between the driving roller and the follower roller, the outer peripheral portion of the follower roller being configured to be only source of generating a tension applied to the transfer belt; and a transfer belt unit comprising the driving roller, the follower roller, the transfer belt and a frame for supporting the driving roller and the follower roller, the transfer belt unit being configured to be mounted on and demounted from the image forming apparatus, and the frame being configured to change a distance between the driving roller and the follower roller.

* * * * *